US005507667A

United States Patent [19]

Hahn et al.

[11] Patent Number: 5,507,667

[45] Date of Patent: Apr. 16, 1996

[54] POWER CORD SECURING AND STORAGE DEVICE

[75] Inventors: Stan S. Hahn, Moraga; Sung Kim, Palo Alto, both of Calif.

[73] Assignee: Asian Micro Sources, Inc., Moraga, Calif.

[21] Appl. No.: 240,840

[22] Filed: May 11, 1994

[51] Int. Cl.[6] ..... H01R 13/72

[52] U.S. Cl. ..... 439/501; 439/638; 439/528

[58] Field of Search ..... 439/501, 502, 439/527, 528, 568, 574, 575, 350, 369, 4, 456, 457; 174/135; 191/12.4

[56] References Cited

U.S. PATENT DOCUMENTS 3,068,316 12/1962 Witt ..... 439/501 X
4,095,871 6/1978 Holte ..... 439/501
4,647,139 3/1987 Yang ..... 439/501 X
5,071,367 10/1991 Luu ..... 439/501

*Primary Examiner*—Khiem Nguyen
*Attorney, Agent, or Firm*—Crosby, Heafey, Roach & May

[57] ABSTRACT

An electrical device is provided with one or more channels in one side, e.g. an end, of the device so that a cord connected to the device can be routed through a channel and not extend past that side of the device. A channel restriction is provided so that the cord cannot be removed from the channel without application of some force. In one preferred form, the case design allows for a power output cable to be positioned at right angle to the power supply. This feature, which is especially useful in tight environments such as behind a desk, is accomplished by incorporating a notch molded into the output end of the device as shown on the figures. In addition, the entire output cable is designed to be wrapped around the power supply during storage with the output plug fitted into the plug storage cavity at the bottom of the power supply which also forms the notch.

14 Claims, 3 Drawing Sheets

POWER CORD SECURING AND STORAGE DEVICE

FIELD OF THE INVENTION

The present invention relates generally to a securing and storage device for a cord, particularly a power cord for a power supply.

BACKGROUND OF THE INVENTION

People in today's world rely heavily on a wide variety of electrical devices. Almost all of these devices draw power ultimately from a commercial source, usually delivered to the user through a wall outlet or socket. Most wall sockets have two (duplex) or four (quad) adjacent plugs.

A large number of these devices require a low voltage DC power input, typically available through a power supply. The required power supplies tend to be large, even those for providing small current outputs. Unfortunately, most small power supplies are too bulky to be plugged into a wall socket and still allow room for other devices, even simple plugs but also including other power supplies, to be plugged into the same wall socket.

Modem telephones, answering machines, radios, recording machines, facsimile machines, computer accessories such as modems, and many others are designed without internal power supplies and instead rely on an external power supply. Another large class of electrical devices is various portable electrical devices that use rechargeable batteries. For many devices, such as portable phones, electronic cameras, video games, calculators, tape players, and the like, a battery is or can be fitted within the device itself. For some devices, the battery can be removed easily, while in other devices, the battery is not designed to be removed.

A variety of power supplies and battery chargers are available for use with such devices. In general, a manufacturer provides a power supply or battery charger specifically designed for use with one or more products. Traditionally, the power supplies or battery chargers are bulky devices, often weighing 500 grams or more. The specific size of the battery charger is determined by a number of factors, including power to be delivered during product use or recharging and the presence or absence of special circuitry, for example to monitor the state of charge of a battery.

In one typical configuration, a power cord goes between the power supply and a wall socket, with a second power cord extending between the power supply and the electrical device. In another typical configuration, the power supply is built into a module which is designed to be plugged directly into a wall socket, with a single cord connecting the power supply to the battery. Traditional wall-mounted power supply modules have been relatively large. However, even the new, smaller wall-mounted power supplies provide only limited power or are too large for many applications.

Many power supplies or battery chargers are designed to be wall-mounted simply by virtue of plugging into a wall socket. A typical device includes a casing which terminates in a plug which is designed to plug directly into the wall socket. The casing is often designed to lie against a wall to provide mechanical stability and to maintain the plug prongs in proper contact with the wall socket.

Electrical plugs have an orientation and various power supplies are designed to extend in different directions relative to the plug. For example, a traditional American plug has two, parallel flat prongs, with the neutral prong slightly wider than the hot prong, plus, for many plugs, a cylindrical ground lead positioned relative to the flat prongs to form a triangle. Wall sockets are usually installed with the ground socket below the prong sockets, but this orientation is sometimes altered. Most power supplies are designed so the bulk of the device extends away from the plane of the two prongs in the direction of the ground lead, but others have the opposite orientation and a few are rotated by 90°.

The problem is accentuated in that most power supplies have a power cord running from the power supply for some distance to an adapter plug or an electrical device and this cord is normally positioned perpendicular to and pointing away from the plane defined by the two main prongs. This extends still farther the area covered by the power supply.

Two significant problems affect use of power cords from such power supplies. The first is one of clearance. Although many power supplies have been oriented so that the power cord extends parallel to the plane of the face of a plug (i.e. along the wall for a wall socket), some newer supplies orient the power cord perpendicular to that plane. In a tight clearance situation, such as is common behind or under furniture, a cord extending in any particular direction can cause problems. Users have been waiting for a device that would allow selective direction of the power cord relative to the plug, but to date, no effective solution has been proposed.

The second major problem with power cords is the jumble caused by even one cord but significantly complicated in a situation with more than one power cord. In general, an electrical device is used a fixed distance away from the power source, but almost never at exactly the length of the power cord. This results in the power cord being draped, folded, or simply dropped in some manner. In many situations, there are multiple power cords with extra length and these cords lie in or around each other. As each new device is plugged in, or an older device is unplugged, then later re-plugged, it is common to re-order the orientation of various power cords so the situation soon resembles a plate of cooked spaghetti, with cords wrapped around others in a sometimes complex knot.

The new device of this invention overcomes these problems by providing a means of easily securing a power cord in a selected orientation. In addition, the new device allows some or even all of the power cord to be wrapped around the device and secured with very close to the desired length of cord remaining free.

SUMMARY OF THE INVENTION

The present device provides an electrical device with one or more channels in one side of the device so that a cord connected to the device can be routed through a channel so as not to extend past that side of the device. Some sort of channel restriction is provided so that the cord cannot be removed from the channel without application of some force.

The case design allows for the power output cable to be positioned at right angle to the power supply. This feature, which is especially useful in fight environments such as behind a desk, is accomplished by incorporating a notch molded into the output end of the device as shown on FIG. 2A. In addition, the entire output cable is designed to be wrapped around the power supply during storage with the output plug fitted into the plug storage cavity at the bottom of the power supply which also forms the notch.

One object of the invention is to provide a device for securing a cord such as a power cord.

Another object of the invention is to provide a device for storing a cord such as a power cord.

DESCRIPTION OF THE PREFERRED EMBODIMENTS

Figure 1A:
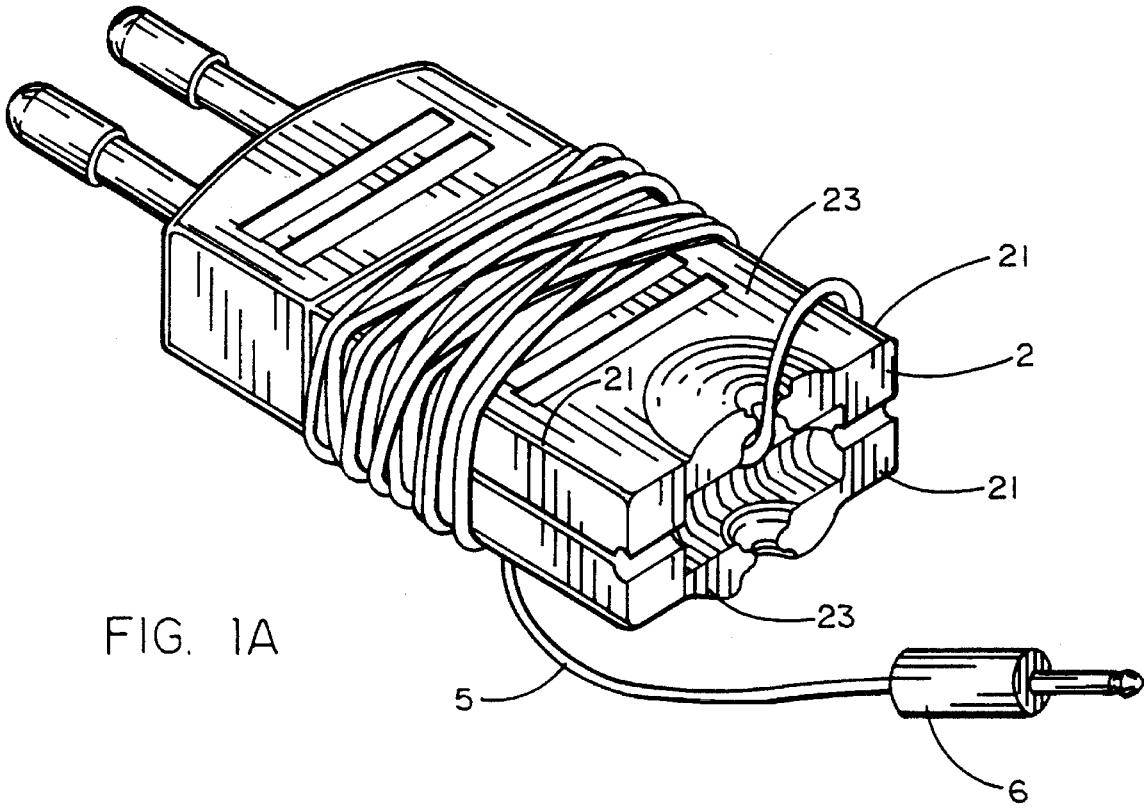
FIG. 1A illustrates the cord storage device with the power cord ready to be stowed.

The new device can be adapted to work with a wide variety of electrical devices with a wide variety of configurations. In one preferred embodiment, an electrical device such as a power supply is placed into a package approximately the size of a standard wall plug.

Referring to FIGS. 2A, 2B, 2C and 2D, casing 1 has outside dimensions of about 55 mm×42 mm×54 mm, a volume of about 125 cc. Some of this volume can be used for various design features, such as plug storage cavity 2. Casing 1 is preferably formed from top half 1A and bottom half 1B, which may be joined by any of a number of methods well known in the art, including snap-fitting, gluing and ultrasonic welding. Plug 10 with prongs 11 may be permanently secured to or integrated with casing 1 or may be detachably secured by a variety of methods, as further described below. Prongs 11 are electrically connected to a power supply which in turn is connected to cable 5 and ultimately to power adapter plug 6 to provide power to an electrical device (not shown).

In a preferred embodiment, plug 10 is 20 mm long for an overall case length of 75 mm, and prongs 11 are 18 mm long for an overall device length of 93 mm. An alternative embodiment incorporates plug 10 into casing 1 to provide a total case length of 55 mm and overall length of 73 mm.

The overall package size preferably is less than about 250 cubic centimeters, more preferably less than about 200 cubic centimeters and still more preferably less than about 125 cubic centimeters. One particularly preferred embodiment has outside dimensions of 42 mm×54 mm×75 mm (170 cc), including case 1 and plug 10. An alternative embodiment with an integrated plug tins outside dimensions of 42 mm×54 mm×55 mm (125 cc).

Casing 1 can be modified with enhancements such as ridges 3 (e.g., 1 mm high, 1–2 mm wide) and grip 4 (e.g., 3 mm high, radius 20 mm). In one preferred embodiment, the edges 21, rear 22 and top/bottom surfaces 23 of casing 1 are rounded (radii 3 mm, 197 mm and 365 mm, respectively).

Figure 1B:
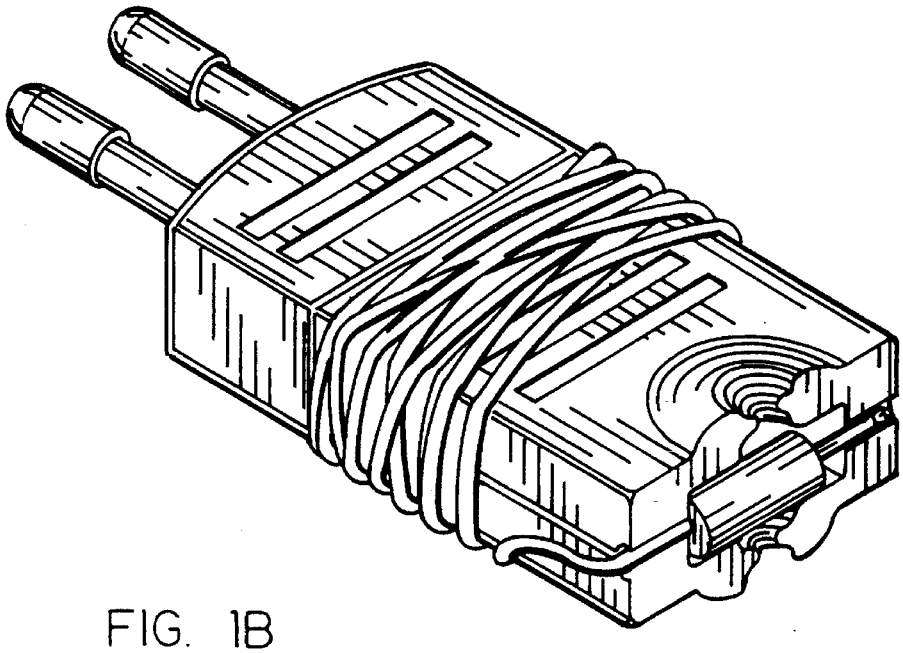
FIG. 1B shows the storage device with the power plug stored in the device.
Figure 3A:
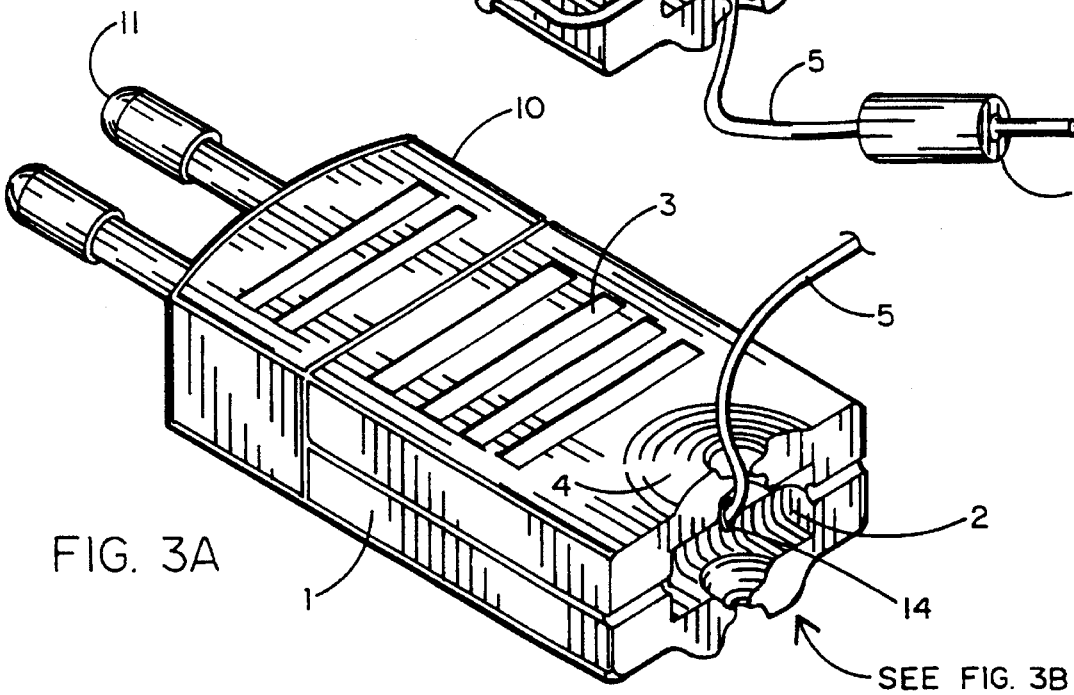
FIGS. 3A and 3B illustrate a cord-securing feature of the device.
Figure 3B:
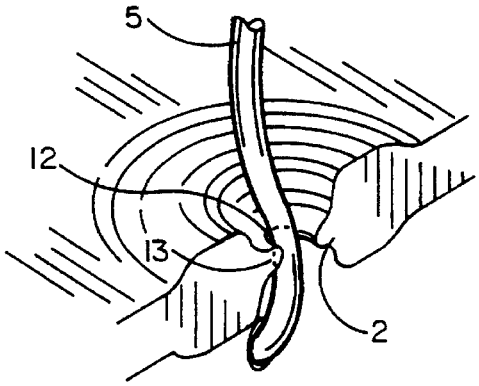
Figure 2A:
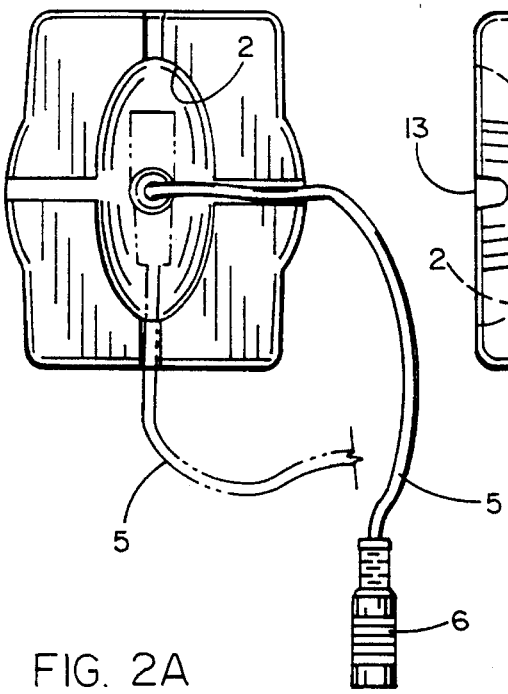
FIGS. 2A, 2B, 2C and 2D illustrate several views of one preferred embodiment of the invention.
Figure 2B:
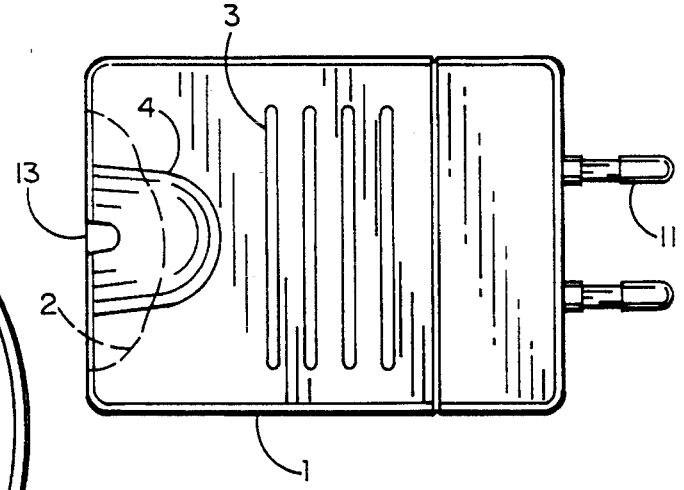
Figure 2C:
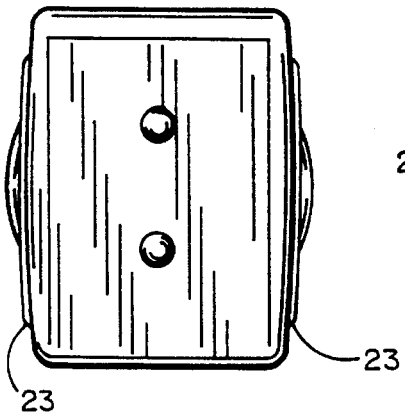
Figure 2D:
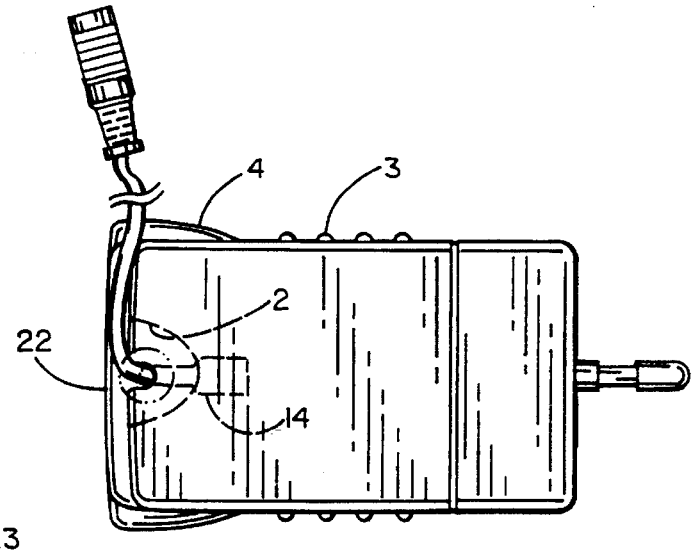

Referring to FIGS. 1A and 1B, power cord 5 is connected at one end through strain relief 14 to casing 1 and terminated in power adapter plug 6 at the other end. Casing 1 includes one or more channels 12 through which cord 5 can be routed so that cord 5 does not extend beyond rear 22 of casing 1. Referring to FIGS. 3 A and 3B, one or two small bumps 13 partially close a channel 12 so that cord 5 is retained within the channel but can be removed with a moderate effort.

The new device provides for convenient partial or complete storage of the power cord. Referring to FIG. 1A, power cord 5 can pass through a channel 12 and then be wrapped one or more times around the body of casing 1. Referring to FIG. 1B, the portion of cord 5 near power adapter plug 6 can be positioned in a second channel 12 and power adapter plug 6 can be pushed into plug storage cavity 2. In one preferred embodiment, plug storage cavity 2 is designed to specifically fit power adapter plug 6 in one or more orientations so that power adapter plug 6 can be gently pressed into place and secured by tension caused by a slight interference where plug storage cavity 2 is slightly smaller than the corresponding dimension of power adapter plug 6.

In one preferred embodiment, casing 1 is contoured to assist wrapping cord 5 around it. Top/bottom portions 23 of casing 1 are slightly rounded (radius 365 mm) and each of edges 21 is rounded (radius 3 mm).

Figure 1C:
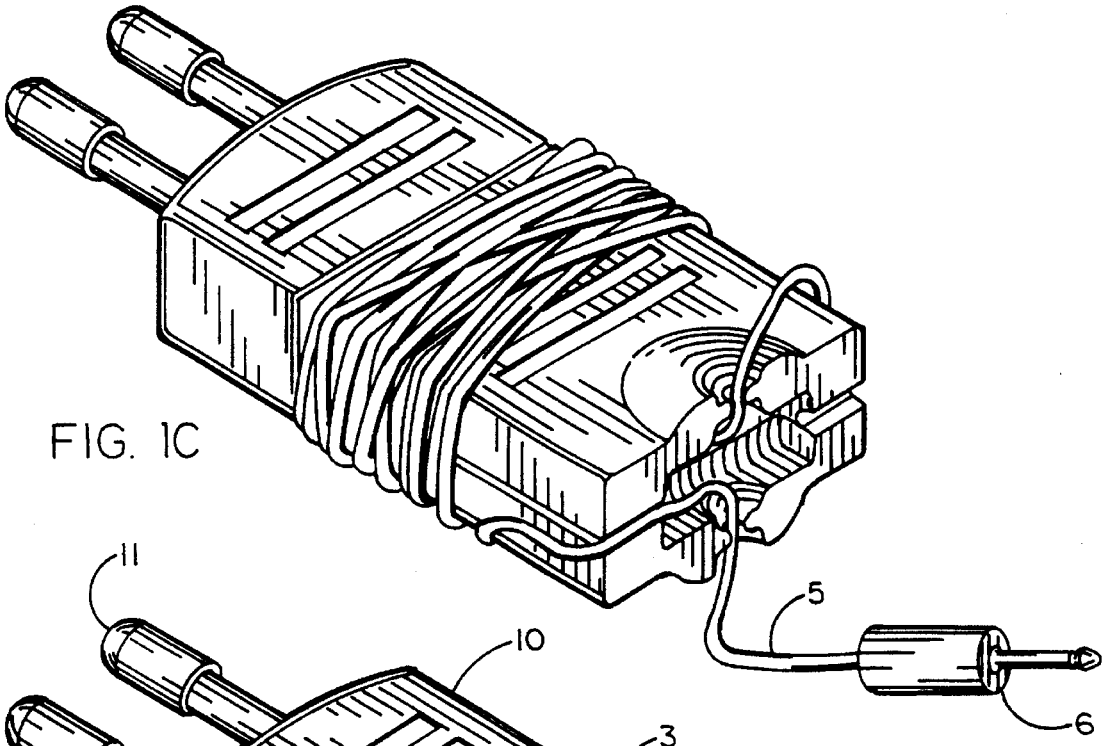
FIG. 1C illustrates an alternative view of the device with the power cord partially stored.

The device is also useful for securing only part of the power cord. In many installations, the electrical device which requires power is closer to the wall socket than the available length of cord 5. Referring to FIG. 1C, an appropriate portion of cord 5 can be wrapped around casing 1, then secured at an intermediate length by passing cord 5 through a channel 12 to secure the wrappings around casing 1. If rear clearance is tight, cord 5 can be passed through an additional channel 12, further securing the cord and keeping all portions of cord 5 as close to plug 10 and prongs 11 as possible.

The cord securing and storage device can be used advantageously in combination with two other recent developments.

A compact power supply features a package with an included volume of less than about 250 cubic centimeters, a switching power supply contained in the package, the power supply capable of providing more than about 5 watts of power, and connections from input power to and for output from the power supply. The power supply can be configured on three circuit boards, in a U-shaped configuration. The boards may be partially or fully potted to provide improved thermal performance and safety. The electronic components are carefully selected and matched for maximum output performance. The power supply is more fully described in the copending, commonly-owned patent application entitled HIGH OUTPUT, COMPACT POWER SUPPLY, filed simultaneously herewith (no Serial No. yet assigned).

Universal application of the power supply is accomplished through the use of interchangeable input connectors which allow the user to select the appropriate input plug for the nation in which it is being used. The interchange of input plugs is accomplished through the use of either a bayonet mount or a dovetail mount. The interchangeable plug feature is more fully described in the copending, commonly-owned patent application entitled INTERCHANGEABLE PLUG DEVICE FOR POWER SUPPLY, filed Apr. 26, 1994 (no Serial No. yet assigned), which in turn is a continuation-in-pan of copending, commonly-owned application Ser. No. 08/201,397, entitled INTERCHANGEABLE PLUG DEVICE FOR BATTERY CHARGER, filed Feb. 24, 1994.

A general description of the device and method of using the present invention as well as a preferred embodiment of the present invention has been set forth above. One skilled in the an will recognize and be able to practice many changes in many aspects of the device and method described above, including variations which fall within the teachings of this invention. The spirit and scope of the invention should be limited only as set forth in the claims which follow.

What is claimed is:

1. A cord securing device comprising an electrical device having a first side and a second side adjacent to and adjoining said first side, a cord connected by a first end of said cord to said electrical device and extending from said first side, a channel in said first side with an opening in said second side, said channel large enough to accommodate a portion of said cord an adapter plug connected to said cord at a second end of said cord a recess in a side of said electrical device, said recess being larger than said adapter plug wherein said adapter plug can be selectively positioned in said recess and a portion of said recess is smaller in dimension than a corresponding portion of said adapter plug so that when said adapter plug is so selectively positioned it is retained within said recess and cord securing means to restrict said channel so that said cord cannot be removed from said channel without application of some force.

2. The cord securing device of claim 1 wherein said first side is approximately perpendicular to said second side.

3. The cord securing device of claim 1 wherein said cord has a resting diameter and said channel has a cross-section which is between 100% and 200% of said resting diameter of said cord.

4. The cord securing device of claim 3 wherein said channel comprises a partially open portion along a portion of said first side.

5. The cord securing device of claim 1 wherein said cord can be compressed to a compressed diameter which is smaller than said resting diameter and wherein said cord securing means comprises a restriction in part of said partially open portion of said channel, said restriction being narrower than said resting diameter but at least as wide as said compressed diameter.

6. The cord securing device of claim 5 further comprising a plurality of said channels, each including said cord securing means.

7. The cord securing device of claim 1 wherein said electrical device is a power supply.

8. The cord securing device of claim 1 wherein said cord is a power cord.

9. The cord securing device of claim 8 further comprising a power adapter plug connected to said power cord at a second end of said power cord.

10. The cord securing device of claim 9 further comprising a recess in a side of said electrical device, said recess being larger than said power adapter plug.

11. The cord securing device of claim 10 wherein said power adapter plug can be selectively positioned in said recess and a portion of said recess is smaller in dimension than a corresponding portion of said power adapter plug so that when said power adapter plug is so selectively positioned it is retained within said recess.

12. The cord securing device of claim 1 wherein said electrical device is shaped to allow said cord to be wrapped around the device.

13. The cord securing device of claim 11 further comprising a plurality of ridges on the surface of said device arranged to lie generally parallel with said cord when said cord is wrapped around said device.

14. A cord securing device comprising an electrical device having a first side and a second side adjacent to and adjoining said first side, a cord connected by a first end of said cord to said electrical device and extending from said first side, a channel in said first side with an opening in said second side, said channel large enough to accommodate a portion of said cord an adapter plug connected to said cord at a second end of said cord a recess in a side of said electrical device, said recess being larger than said adapter plug wherein said adapter plug can be selectively positioned in said recess and a portion of said recess is smaller in dimension than a corresponding portion of said adapter plug so that when said adapter plug is so selectively positioned it is retained within said recess, and cord securing means to restrict said channel so that said cord cannot be removed from said channel without application of some force.

* * * * *

UNITED STATES PATENT AND TRADEMARK OFFICE

CERTIFICATE OF CORRECTION

PATENT NO. : 5,507,667

DATED : April 16, 1996

INVENTOR(S) : Hahn et al.

It is certified that error appears in the above-identified patent and that said Letters Patent is hereby corrected as shown below:

In column 2, line 1, delete "two, parallel" and insert therefor --two parallel,--.

In column 2, line 60, after "at" insert --a--.

In column 2, line 61, delete "fight" and insert therefor --tight--.

In column 3, line 28, delete "54 mm," and insert therefor --54 mm and--.

In column 3, line 52, delete "tins" and insert therefor --has--.

In column 4, line 45, delete "(no Serial No. yet assigned)." and insert therefor --and now issued as U.S. Patent No. 5,568,365."

In column 4, lines 54-55, delete "1994 (no Serial No. yet assigned)," and insert therefor --1994, now abandoned,".

In column 4, line 58, after "1994" insert --, now abandoned--.

UNITED STATES PATENT AND TRADEMARK OFFICE

CERTIFICATE OF CORRECTION

PATENT NO. : 5,507,667

DATED : April 16, 1996

INVENTOR(S) : Hahn et al.

It is certified that error appears in the above-indentified patent and that said Letters Patent is hereby corrected as shown below:

In column 4, line 62, delete "an" and insert therefor --art--.

Signed and Sealed this

Twentieth Day of May, 1997

*Attest:*

Bruce Lehman

BRUCE LEHMAN

*Attesting Officer*

*Commissioner of Patents and Trademarks*